US007261093B2

(12) United States Patent
Groom et al.

(10) Patent No.: US 7,261,093 B2
(45) Date of Patent: Aug. 28, 2007

(54) EVAPORATIVE EMISSIONS CONTROL FUEL CAP

(75) Inventors: J Bradley Groom, Oxford, OH (US); Yip Cheung Kwok, Indianapolis, IN (US); Michael S. Brock, Connersville, IN (US)

(73) Assignee: Stant Manufacturing Inc., Connersville, IN (US)

( * ) Notice: Subject to any disclaimer, the term of this patent is extended or adjusted under 35 U.S.C. 154(b) by 132 days.

(21) Appl. No.: 11/184,474

(22) Filed: Jul. 19, 2005

(65) Prior Publication Data

US 2006/0016436 A1 Jan. 26, 2006

Related U.S. Application Data

(60) Provisional application No. 60/589,761, filed on Jul. 21, 2004.

(51) Int. Cl.
*F02M 33/04* (2006.01)
*F02M 33/00* (2006.01)

(52) U.S. Cl. ..... 123/520; 123/519

(58) Field of Classification Search ..... 123/520, 123/519, 518, 516; 137/588, 587, 583; 220/86.2, 220/746; 141/326, 59
See application file for complete search history.

(56) References Cited

U.S. PATENT DOCUMENTS

| | | | | |
|---|---|---|---|---|
| 3,172,348 | A * | 3/1965 | Berg | 454/162 |
| 3,961,724 | A * | 6/1976 | Kapsy | 220/371 |
| 4,696,409 | A * | 9/1987 | Vize | 220/203.2 |
| 4,762,247 | A * | 8/1988 | Temmesfeld | 220/303 |
| 4,813,453 | A * | 3/1989 | Jenkins et al. | 137/588 |
| 4,816,045 | A * | 3/1989 | Szlaga et al. | 96/164 |
| 4,884,716 | A * | 12/1989 | Steiner | 220/202 |
| 5,042,678 | A * | 8/1991 | Munguia | 220/254.9 |
| 5,259,412 | A * | 11/1993 | Scott et al. | 137/588 |
| 5,375,633 | A * | 12/1994 | Bucci | 141/59 |
| 5,964,204 | A * | 10/1999 | Freeland | 123/516 |
| 6,189,581 | B1 * | 2/2001 | Harris et al. | 141/348 |
| 6,193,093 | B1 * | 2/2001 | Brunner | 220/234 |
| 2002/0088801 | A1 * | 7/2002 | Temmesfeld | 220/86.2 |
| 2006/0090815 | A1 * | 5/2006 | Sakraschinsky et al. | 141/326 |

* cited by examiner

*Primary Examiner*—Mahmoud Gimie
(74) *Attorney, Agent, or Firm*—Barnes & Thornburg LLP

(57) ABSTRACT

An evaporative emissions control fuel cap system comprises a closure adapted to mate with a fuel tank. The closure includes a passageway formed therein to conduct vapors from the fuel tank to the atmosphere. The closure includes a filter configured to capture hydrocarbons positioned in the passageway so that fuel vapor flowing from the fuel tank is scrubbed of hydrocarbons before being discharged to the atmosphere.

44 Claims, 6 Drawing Sheets

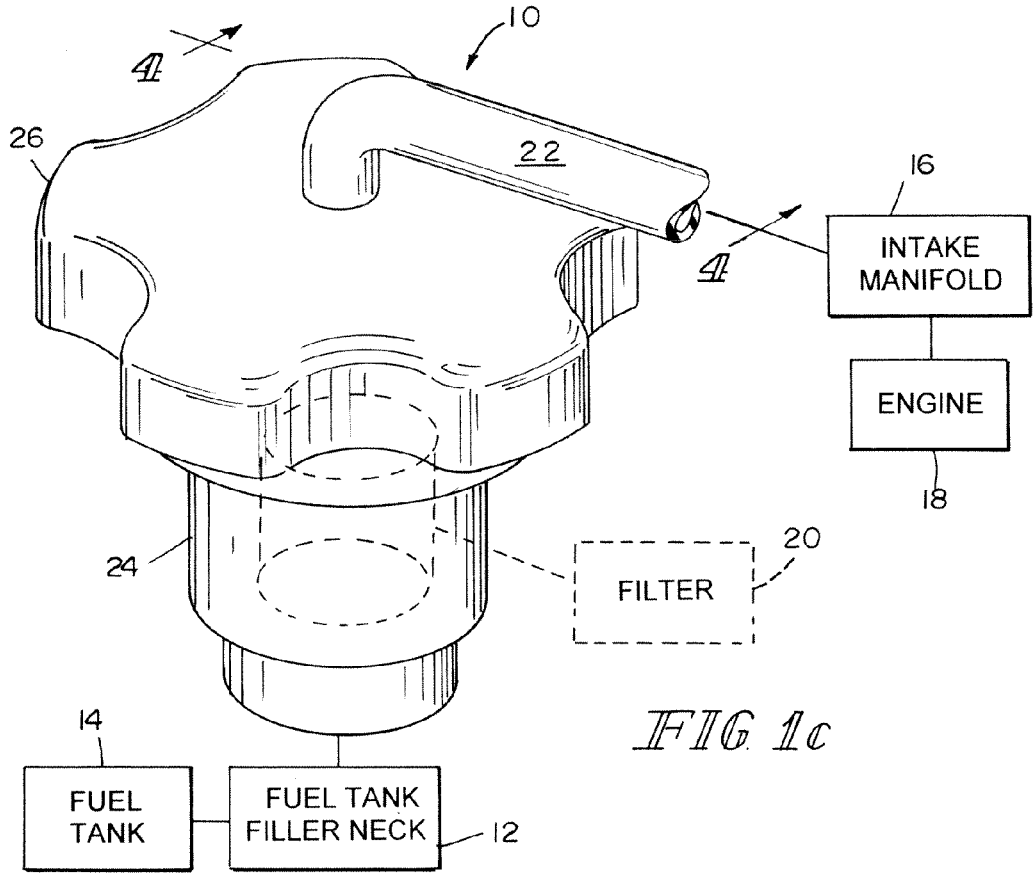
FIG. 1c
FIG. 2
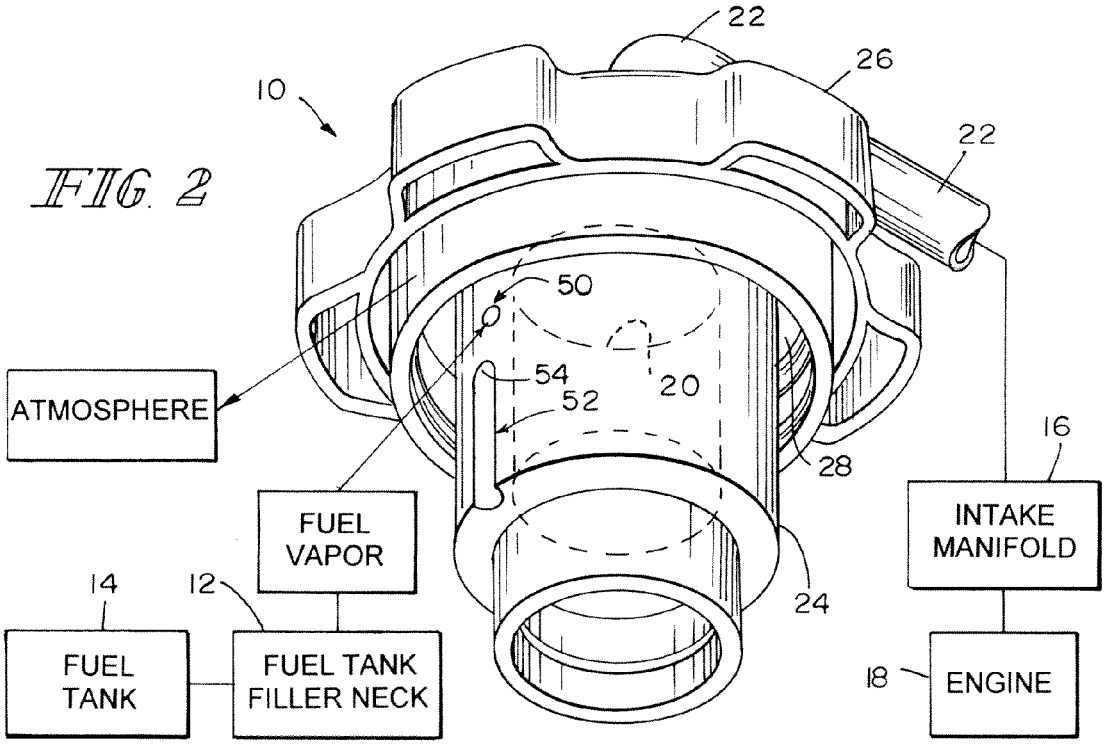

EVAPORATIVE EMISSIONS CONTROL FUEL CAP

This application claims priority to U.S. Provisional Application No. 60/589,761 filed Jul. 21, 2004, which is expressly incorporated by reference herein.

BACKGROUND

The present disclosure relates to a fuel cap, and particularly to a fuel cap for use on a fuel tank filler neck associated with a small engine of an off-road vehicle or other apparatus. More particularly, the present disclosure relates to evaporative emissions control of small off-road engines.

Vehicle fuel systems include valves associated with a fuel tank and configured to vent pressurized or displaced fuel vapor from the vapor space in the fuel tank to a separate vapor recovery canister. The canister is designed to capture and store hydrocarbons entrained in fuel vapors that are displaced and generated in the fuel tank.

It is desired to limit daily hydrocarbon evaporative emissions from small off-road engine (SORE) systems included in gas-powered products such as, for example, lawn mowers, all-terrain vehicles, go-karts, string trimmers, and leaf blowers. Such limits could be achieved by capturing hydrocarbons emitted by SORE systems and conducting captured hydrocarbons to the engine for combustion.

SUMMARY

The present disclosure relates to an evaporative emissions fuel system including one or more of the following features or combinations thereof.

A fuel cap in accordance with the present disclosure includes a closure adapted to close a mouth of a fuel tank filler neck. A hydrocarbon filter is located in the closure to capture hydrocarbon material (e.g., by adsorption) from hydrocarbon-laden fuel vapor conducted through passageways formed in the closure and subsequently discharged as "scrubbed" vapor to the atmosphere.

In illustrative embodiments, a purge hose coupled to the closure provides a fluid path from the hydrocarbon filter to an intake manifold coupled to an engine associated with the fuel tank filler neck and acts as a cap tether. The purge hose conducts hydrocarbon-laden fuel vapor from the hydrocarbon filter to the intake manifold by means of a purge vacuum applied to the hydrocarbon filter by the intake manifold when the engine is running. This purge operation cleans and regenerates the hydrocarbon filter when the engine is running.

In illustrative embodiments, a normally closed check valve located in the closure and exposed to a purge vacuum extant in the purge hose is movable in response to the purge vacuum to an opened position drawing atmospheric air into and through the hydrocarbon. This causes hydrocarbon material adsorbed on the hydrocarbon filter to be entrained into the atmospheric air drawn through the hydrocarbon filter. This produces a stream of fuel vapor laden with "reclaimed" hydrocarbon material that is discharged from the hydrocarbon filter through the purge hose into the intake manifold for combustion in the engine.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 1*c* is a perspective view of a fuel cap in accordance with the present disclosure showing a closure adapted to mate with a fuel tank filler neck, a cover arranged to overlie the closure and adapted to be gripped and moved by a user to remove the closure from the fuel tank filler neck, and a purge hose arranged to pass through an aperture formed in the cover to conduct hydrocarbons captured and stored in a hydrocarbon filter (shown in phantom) located in the closure to an intake manifold coupled to an engine associated with the fuel tank filler neck;

FIG. 2 is another perspective view of the fuel cap of FIG. 1*c* showing a fuel vapor entry port formed in the closure and coupled to the fuel tank filler neck to receive fuel vapor from the fuel tank therein whenever the engine is both running and not running and also showing a rollover ball guide channel formed in the closure and sized to guide a rollover ball from a channel-opening position shown in FIG. 4 to a channel-closing position shown in FIG. 6 whenever the fuel cap is tilted excessively or inverted during, for example, rollover conditions;

DETAILED DESCRIPTION

Figures 1A, 1B:
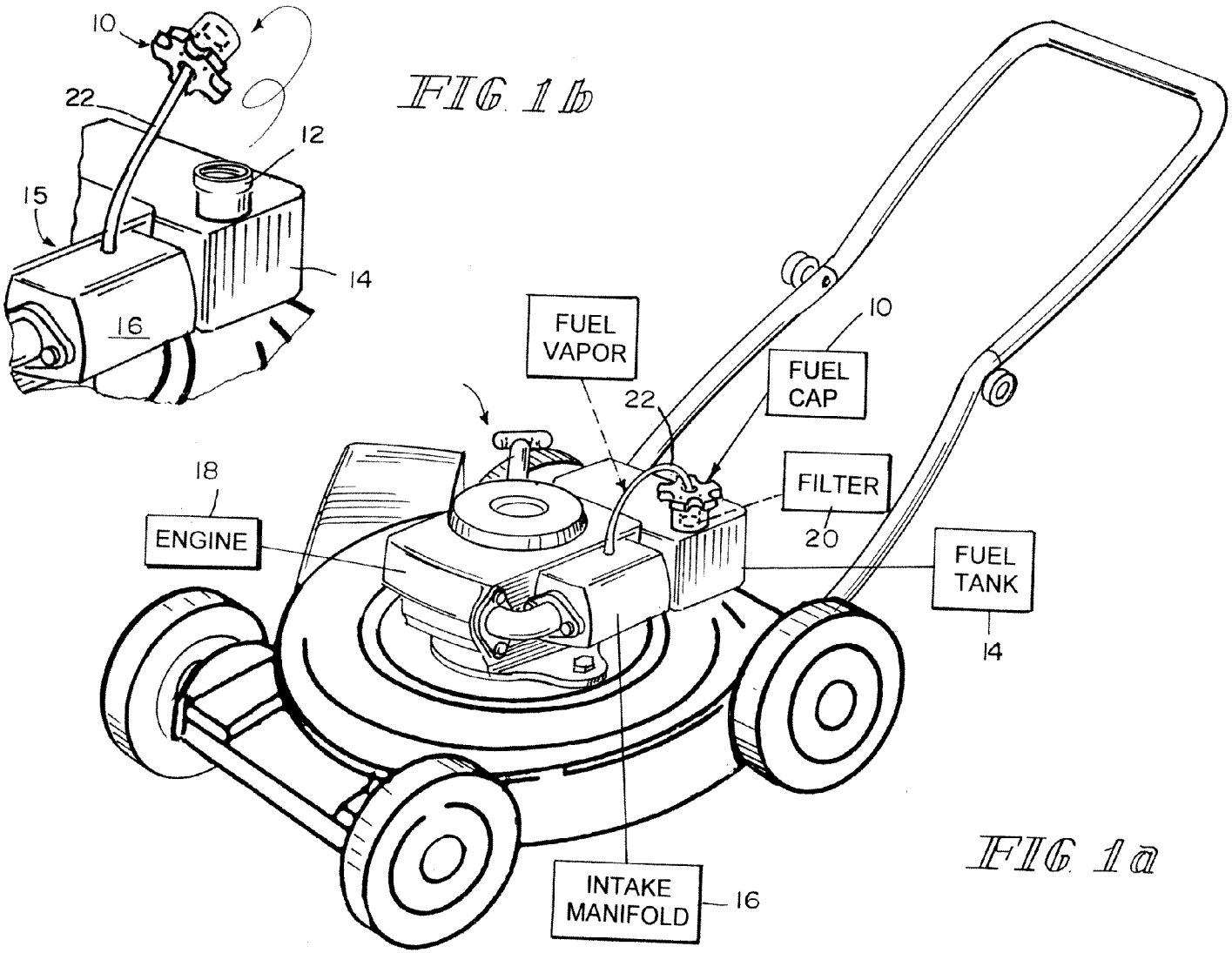
FIG. 1*a* is a perspective view of a lawn mower including an engine, an intake manifold, a fuel tank having a filler neck, and an evaporative emissions control fuel cap in accordance with the present disclosure.
FIG. 1*b* is a perspective view of a portion of the lawn mower illustrated in FIG. 1*a* showing the fuel cap separated from the fuel tank filler neck and tethered by a fuel vapor conducting purge hose coupled to the intake manifold.

A fuel cap 10 is provided to control discharge of evaporative emissions (e.g., fuel vapor 11) from a filler neck 12 coupled to a fuel tank 14. In an illustrative embodiment, fuel cap 10 is used onboard an apparatus provided with a small off-road engine (SORE) system such as, for example, a lawn mower 15 including an intake manifold 16 coupled to an engine 18. Hydrocarbons captured and stored in a hydrocarbon filter 20 included in fuel cap 10 when engine 18 is not "running" are drawn under a purge vacuum into intake manifold 16 through a purge hose 22 also included in fuel cap 10 whenever engine 18 is running so that the hydrocarbons transferred from hydrocarbon filter 20 to intake manifold 16 can be combusted in engine 18. Purge hose 22 also acts as a tether to retain fuel cap 10 in tethered relation to the apparatus containing fuel tank 14 and filler neck 12.

Figure 4:
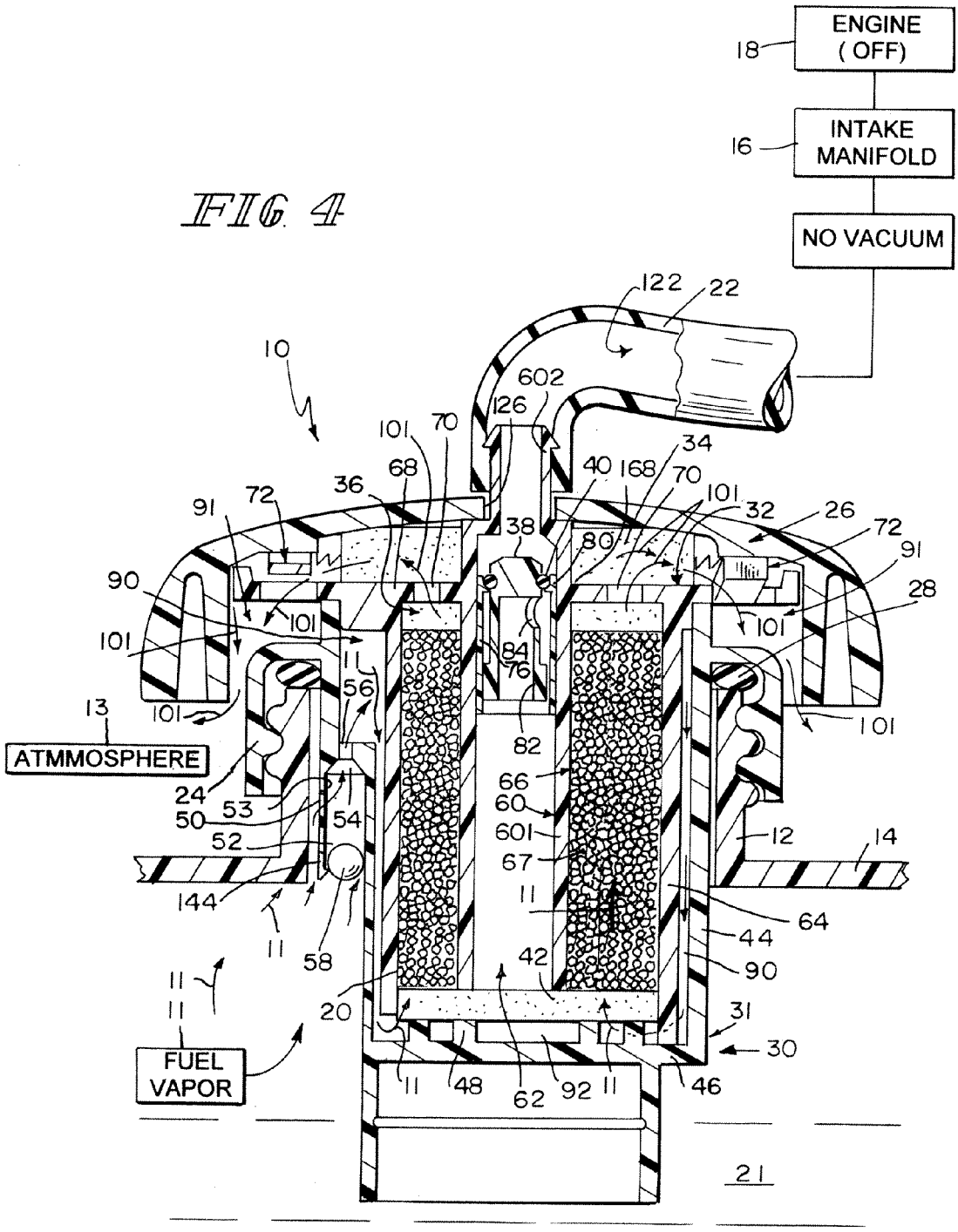
FIG. 4 is a sectional view taken along line 4-4 of FIG. 1*c* showing (1) flow of hydrocarbon-laden fuel vapor into a hydrocarbon filter located in the closure through passageways formed in the closure and subsequent discharge of "scrubbed" vapor to the atmosphere, (2) movement of a check valve located in a center fuel vapor discharge channel extending through the hydrocarbon filter to its normal closed position blocking discharge of fuel vapor in the hydrocarbon filter through the purge hose to the intake manifold whenever the engine is off, and (3) a rollover ball located in an opened position in the rollover ball guide channel located alongside the hydrocarbon filter.

Fuel cap 10 also includes a closure 24 and a cover 26 as suggested in FIG. 1*c* Closure 24 is adapted or structured to mate with and close an open mouth of fuel tank filler neck 12 as suggested in FIG. 1*c* and is also configured to include hydrocarbon filter 20 therein as suggested in FIG. 4. Cover 26 is arranged to overlie closure 24 and adapted to be gripped and moved by a user to remove closure 24 from fuel tank filler neck 12. An O-ring 28 made of fluorocarbon rubber or other suitable sealing material is coupled to closure 24 and arranged to seal against filler neck 12 when fuel cap 10 is mounted on filler neck 12.

It is within the scope of this disclosure to use any suitable "quick-on" means or other filler neck engagement means to mount closure 24 on filler neck 12. Such filler neck engagement means is configured to prevent purge hose 22 from twisting during installation of fuel cap 10 on filler neck 12.

Figure 3:
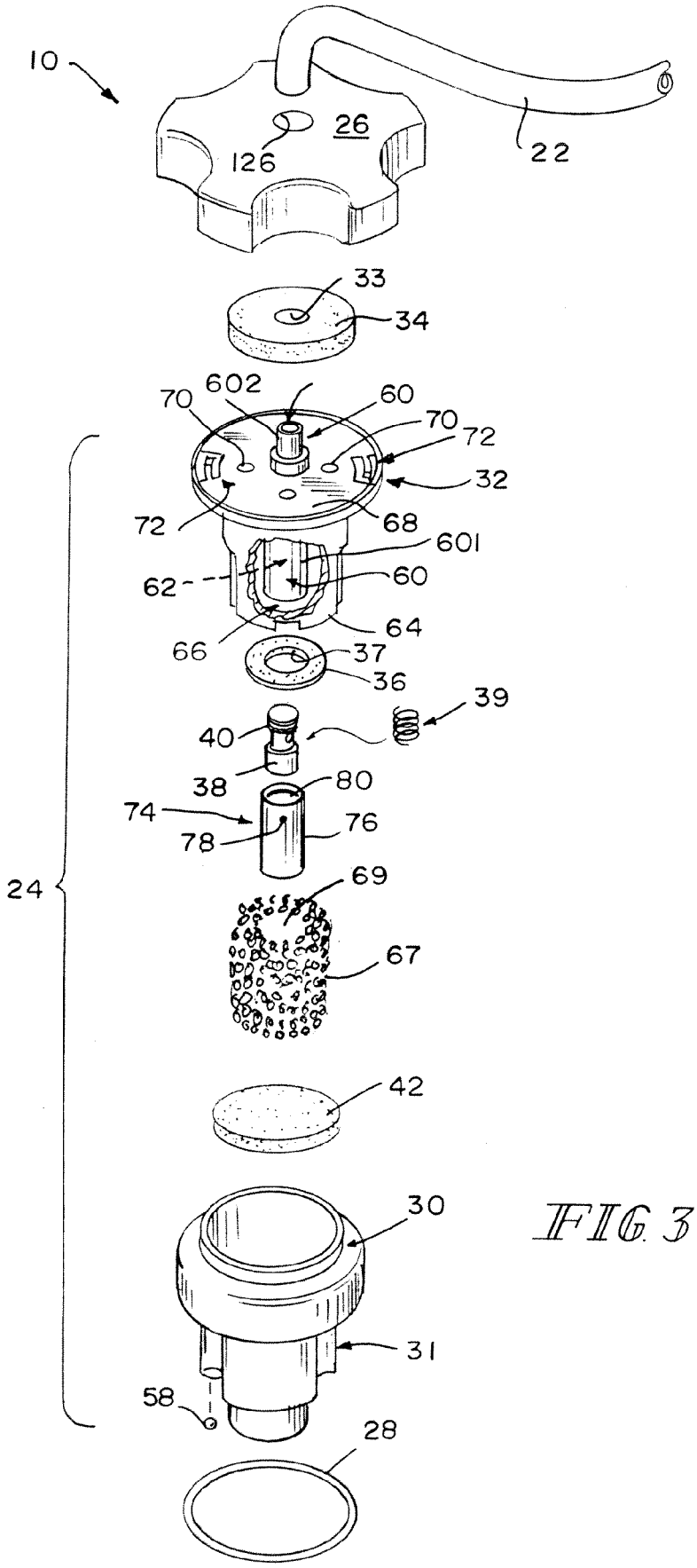
FIG. 3 is an exploded perspective assembly view of the fuel cap of FIGS. 1*c* and 2 showing components included in the fuel cap.

As suggested in FIGS. 3 and 4, closure 24 includes a lower housing 30 configured to carry O-ring 28 and mate with filler neck 12 and an upper housing 32 arranged to extend into a container 31 included in lower housing 30 so as to lie between lower housing 30 and cover 26. In an illustrative embodiment, both lower and upper housings 30, 32 and cover 26 are made of Acetal or other very low permeation material to block permeation of hydrocarbons through those parts to the atmosphere. In an illustrative embodiment, lower and upper housings 30 are welded together hermetically. Closure 24 also includes a fresh-air filter 34, an upper sponge filter 36, a hydrocarbon check valve 38, an O-ring seal 40 carried on check valve 38, a spring 39 (see FIG. 3) for surrounding a necked-down portion of check valve 38 and acting against valve mount 74 and check valve 30 normally to bias check valve 38 to a normally closed position shown in FIG. 4, and a lower sponge filter 42.

Container 31 of lower housing 30 includes a cylindrical side wall 44, a round bottom wall 46 coupled to a lower end of cylindrical side wall 44 to form an interior region, and a plurality of upwardly projecting standoffs 48. Standoffs 48 are coupled to bottom wall 46 as shown, for example, in FIGS. 4 and 5. Standoffs 48 are arranged in spaced-apart relation to one another to provide means for supporting lower sponge filter 42 in the interior region and in spaced-apart relation to bottom wall 46 to define a chamber 92 therebetween so that fuel vapor admitted into container 31 can flow around standoffs 48 and then upwardly into and through lower sponge filter 42.

Container 31 of lower housing 30 is also formed to include a fuel vapor entry port 50 arranged to open into a rollover ball guide channel 52 as suggested in FIGS. 2 and 4. A valve seat 54 is located at an outlet 56 of channel 52. An upper portion 53 of guide channel 52 normally conducts fuel vapor from fuel vapor entry port 50 to outlet 56. Outlet 56, when opened, is arranged to conduct fuel vapor admitted into that upper portion 53 of guide channel 52 into a fuel vapor chamber 90 formed in closure 24 as suggested, for example, in FIGS. 4 and 5.

Figure 6:
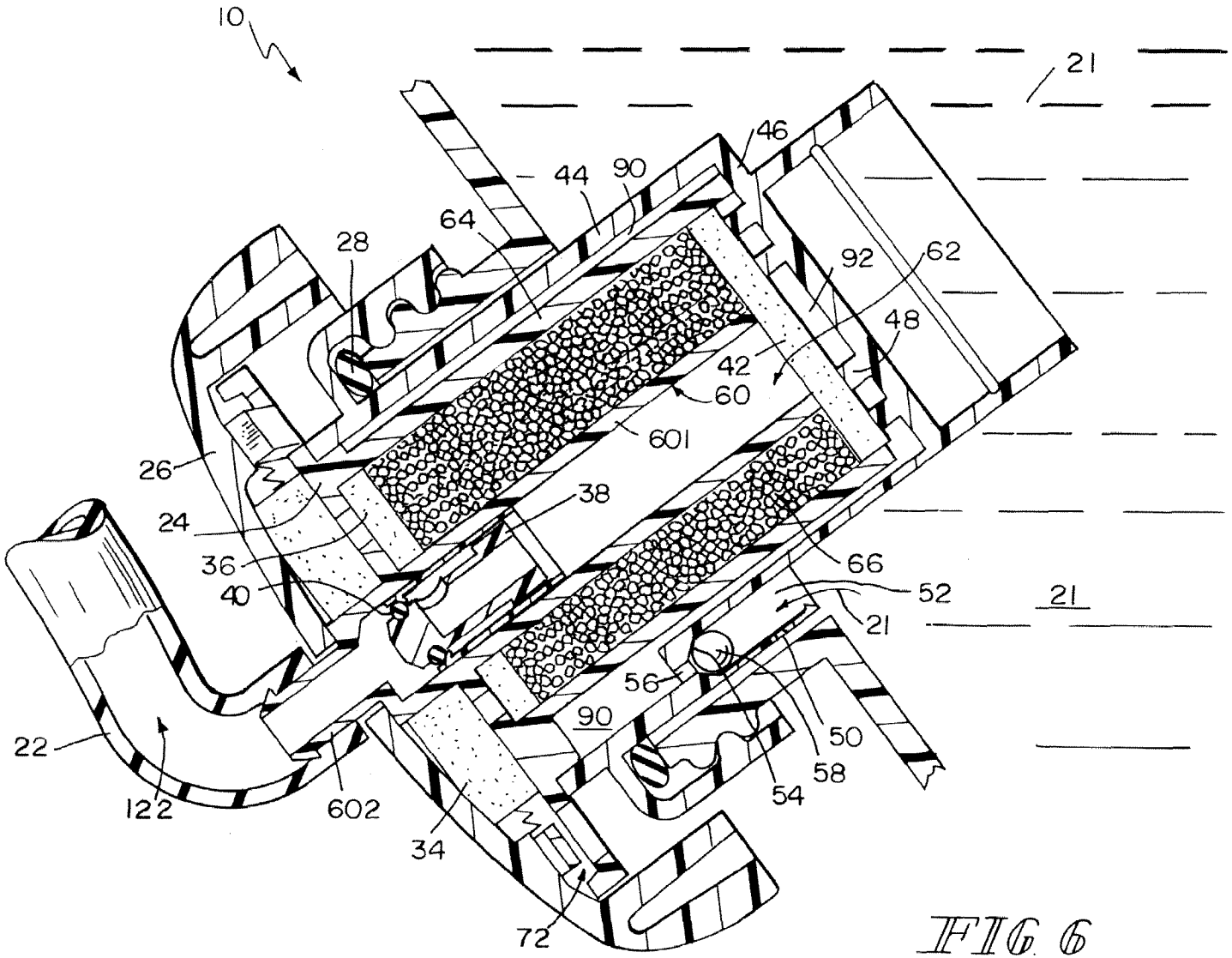
FIG. 6 is a perspective view similar to FIGS. 4 and 5, with portions broken away, showing the rollover ball after it has moved under gravity to a closed position in the rollover ball guide channel during inversion of the fuel cap to block flow of any liquid fuel and fuel vapor extant in the filler neck through the fuel vapor entry port and the rollover ball guide channel into the chambers and passageways formed in the closure during inversion of the fuel cap.

A rollover ball 58 is mounted in rollover ball guide channel 52 for movement (under gravity) between an opened position spaced apart from valve seat 54 as suggested in FIG. 4 and a closed position against valve seat 54 as suggested in FIG. 6. In the opened position, rollover ball 58 is arranged to allow fuel vapor extant in filler neck 12 to flow through fuel vapor entry port 50, upper portion 53 of channel 52, and outlet 56 into chamber 90 formed in closure 24. In the closed position, rollover ball 58 is arranged to block flow of liquid fuel and fuel vapor through outlet 56 into chamber 90 formed in closure 24 during excessive tilting or inversion of fuel cap 10.

Figure 5:
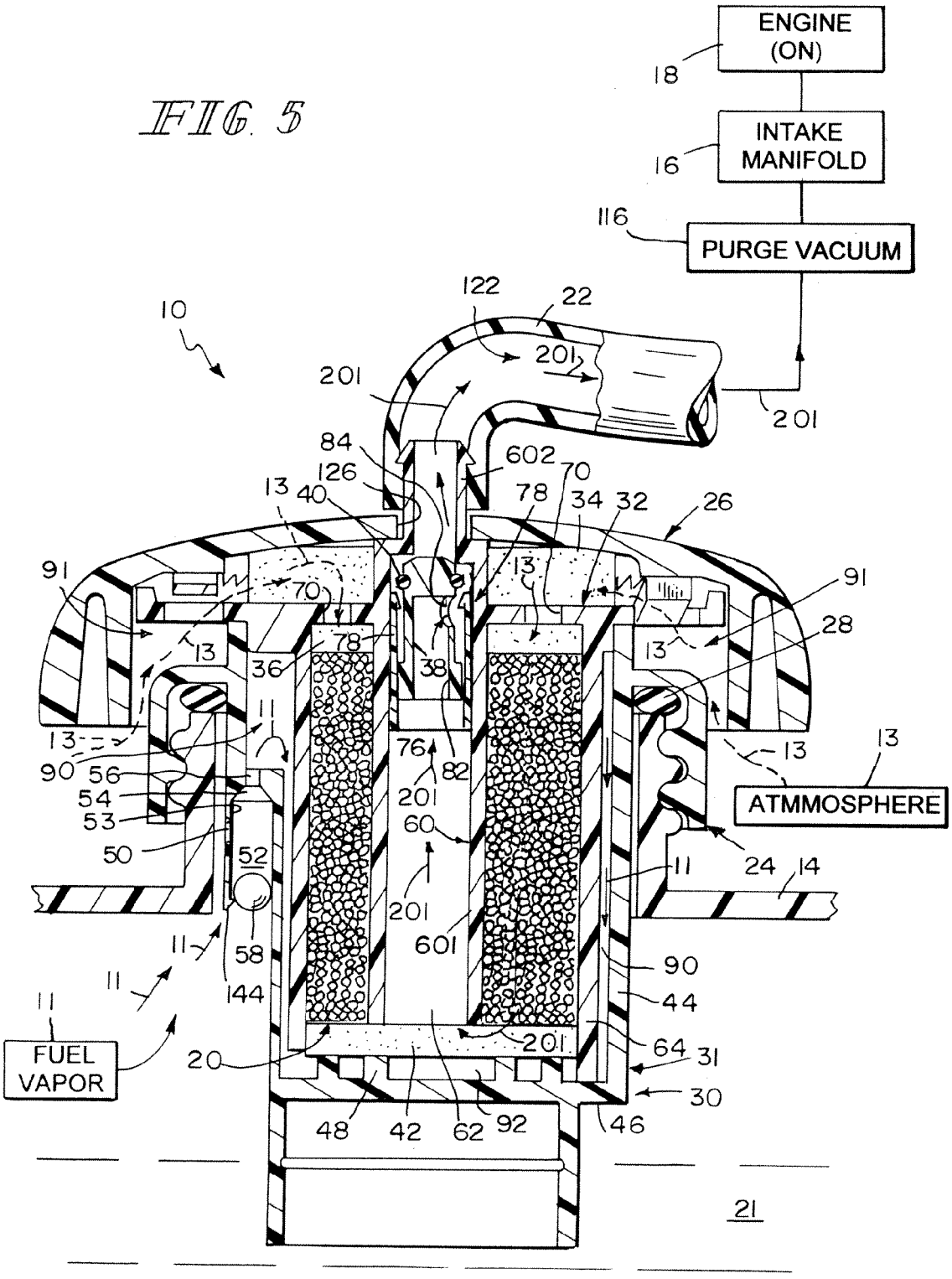
FIG. 5 is a sectional view similar to FIG. 4 showing "purging" of the hydrocarbon filter by means of a vacuum applied to the hydrocarbon filter by the intake manifold whenever the engine is running to move the check valve located in the center fuel vapor discharge channel upwardly to an opened position and causing discharge of fuel vapor (laden with hydrocarbons) from the hydrocarbon filter through the purge hose into the intake manifold for combustion in the engine.

Upper housing 32 includes an inner sleeve 60 formed to define a center fuel vapor discharge channel 62 and an outer sleeve 64 arranged to surround inner sleeve 60 to define an activated charcoal bed storage area 66 therebetween as suggested in FIGS. 4 and 5. Activated charcoal pellets or granules 67 or other suitable hydrocarbon capturing media are stored in charcoal bed storage area 66 as shown, for example, in FIGS. 4 and 5.

Upper housing 32 also includes a top plate 68 coupled to cover 26, an upper end of inner sleeve 60, and an upper end of outer sleeve 64. Top plate 68 is formed to include one or more atmospheric air entry ports 70 to conduct outside air 13 passing through fresh-air filter 34 and through upper sponge filter 36 into charcoal bed storage area 66 to reach activated charcoal pellets 67 stored therein when engine 18 is running as suggested in FIG. 5.

Upper sponge filter 36 is arranged to lie under top plate 68 in a chamber formed in outer sleeve 64 and to surround inner sleeve 60. Lower sponge filter 42 is arranged to lie in that chamber and to surround inner sleeve 60. The charcoal bed storage area 66 is located in that chamber and between upper sponge filter 36 and lower sponge filter 42 and is filled with activated charcoal or other suitable hydrocarbon filtering material 67. Upper and lower sponge filters 36, 42 trap the activated charcoal pellets 67 therebetween yet allow flow of atmospheric air 13 and fuel vapor 11 through the group of activated charcoal pellets 67.

In the illustrated embodiment, inner sleeve 60 has a lower portion 601 that extends through central aperture 37 formed in upper sponge filter 36 and through central aperture or hole 69 formed in hydrocarbon filter material 67. Inner sleeve 60 also has an outer portion 602 that extends through a central aperture 33 formed in fresh-air filter 34 and communicates with purge hose 22.

As suggested in FIGS. 3-5, a torque-override system 72 (of any suitable style) is interposed between and coupled to each of cover 26 and top plate 68. Torque-override system 72 is configured to establish a "torque-limited" connection between cover 26 and top plate 68 during installation of fuel cap 10 on filler neck 12 and a "direct-drive" connection between cover 26 and top plate 68 during removal of fuel cap 10 from filler neck 12.

As suggested in FIGS. 4 and 5, a valve mount 74 is located in center fuel vapor discharge channel 62. Valve mount 74 includes a sleeve 76, sleeve retainers 78 on an exterior surface of sleeve 76, and an annular valve seat 80 on an interior surface of sleeve 76 as shown, for example, in FIGS. 3-5. In the illustrated embodiment, two barbs provide sleeve retainers 78 and engage inner sleeve 60 to establish an interference fit to retain sleeve 76 in a fixed position in inner sleeve 60 of outer housing 32.

Check valve 38 is mounted for movement inside sleeve 76 of valve mount 74 between a closed position against valve seat 80 as shown in FIG. 4 and an opened position away from valve seat 80 as shown in FIG. 5. A biasing spring 39 (shown in FIG. 3) acts between check valve 38 and valve seat 80 to bias check valve 38 normally to the closed position. In the closed position, O-ring seal 40 lies against valve seat 80 as shown, for example, in FIG. 4 to establish a sealed connection therebetween to block flow of fuel vapor from a center fuel vapor discharge channel 62 defined by inner sleeve 60 into purge hose 22. Whenever engine 18 is running, a purge vacuum extant in intake manifold 16 and purge hose 22 will be applied to center fuel vapor discharge channel 62 to move check valve 38 against a biasing force generated by biasing spring 39 to the opened position as suggested in FIG. 5. In the opened position, fuel vapor can flow first through a passageway 82 and then through a side-opening port 84 formed in check valve 38 to bypass valve seat 80 and flow through a discharge channel 86 formed in upper housing 32 into purge hose 22 as suggested, for example, in FIG. 5.

When engine 18 is not running, fuel vapor 11 from filler neck 12 passes through fuel vapor entry port 50, upper portion 53 of guide channel 52 which extends along a first direction, and outlet 56 into chamber 90 formed between cylindrical side wall 44 included in container 31 of lower housing 30 and outer sleeve 64 of upper housing 32 as suggested in FIG. 4. As seen in FIG. 4, the fuel vapor leaving outlet 56 flows in a second direction generally perpendicular to the first direction and enters chamber 90 between outer sleeve 64 and cylindrical side wall 44 and flows along chamber 90 in a third direction generally parallel and opposite to the first direction. Fuel vapor 11 then turns about 90° and passes into chamber 92 located above bottom wall 46 and containing standoffs 48 and then through lower sponge filter 42 into the charcoal bed 67 included in hydrocarbon filter 20. As seen in FIG. 4, the fuel vapor flow through bed 67 extends along a fourth direction generally parallel and opposite to the first direction. Thus, the fuel vapor flow from the entry port 50 into the filter 20 is along a circuitous passageway. Hydrocarbons associated with that fuel vapor 11 are adsorbed by the activated charcoal 67 comprising the charcoal bed of hydrocarbon filter 20 and stored for later use. These activated charcoal granules 67 provide hydrocarbon storage and later release hydrocarbons to intake manifold 16 when engine 18 is running and generating purge vacuum. "Hydrocarbon-scrubbed" vapor 101 is then discharged to atmosphere 13 through a vapor-discharge passageway 91 defined between closure 24 and cover 26 and arranged to contain fresh-air filter 34 and communicate with atmospheric air entry apertures 70 formed in top plate 68.

When engine 18 is not running, check valve 38 is urged by its companion biasing spring 39 to assume the closed position shown, for example, in FIG. 4, thereby blocking any flow of fuel vapor 11 in closure 24 to intake manifold 16 via purge hose 22. Thus, hydrocarbons associated with fuel vapor 11 that passes from fuel tank 14 into filler neck 12 will be captured in hydrocarbon filter 20 included in closure 24.

However, whenever engine 18 is running, a purge vacuum 116 will be applied via intake manifold 16 and purge hose 22 to move check valve 38 against its companion biasing spring 39 to assume the opened position shown, for example, in FIG. 5, thereby allowing flow of fuel vapor 201 laden with hydrocarbons from hydrocarbon filter 20 to intake manifold 16 via purge hose 22 for combustion in engine 18. Thus, hydrocarbons associated with fuel vapor that are captured and stored in hydrocarbon filter 20 are later combusted in engine 18.

Filters 42, 36, and 34 operate to minimize unwanted discharge of certain materials in fuel cap 10 to atmosphere 13 or to fuel tank 14. Lower sponge filter 42 prevents charcoal granules and dust from migrating out of charcoal bed storage area 66 into the purge path or fuel tank 14. Upper sponge filter 36 prevents charcoal granules and dust from migrating out of charcoal bed storage area 66 to atmosphere 13. Fresh-air filter 34 decontaminates air being drawn from the atmosphere into the bed of activated charcoal granules in charcoal bed storage area 66 under vacuum while engine 18 is running. Outside air 13 being drawn in purges or cleans the hydrocarbons from charcoal granules 67. The mixture of air and hydrocarbon is then "pulled" to engine 18 through purge hose 22 and intake manifold 16 and burned in engine 18.

Check valve 38 prevents migration of hydrocarbons from fuel cap 10 through purge hose 22 to intake manifold 16 and out to the surrounding atmosphere through the carburetor. This feature helps to ensure that state and federal hydrocarbon emission requirements are met.

Purge hose 22 functions as a cap tether and provides a path from the charcoal bed 67 in hydrocarbon filter 20 to intake manifold 16. Manifold vacuum is used to draw stored hydrocarbons from the charcoal bed 67 in hydrocarbon filter 20, thereby refreshing charcoal bed 67 for the next "engine-off" period.

Rollover ball 58 provides rollover protection for hydrocarbon filter 20. It moves to a closed position to prevent liquid fuel exposure to the carbon granules, which exposure would degrade performance. Rollover ball 58 could be spring-loaded if a particular product application required closure at lower rollover angles.

In illustrative embodiments, an evaporative emissions control system in accordance with the present disclosure includes a fuel tank filler neck closure 24, a hydrocarbon filter unit 120 comprising a hydrocarbon filter 20, and a filter regeneration system coupled to hydrocarbon filter unit 120 and configured to reclaim hydrocarbon materials captured on hydrocarbon filter 20 as fuel vapor is vented from the filler neck through closure 24 to the atmosphere and deliver the reclaimed hydrocarbon material via intake manifold 16 to engine 18 to be burned.

Closure 24 is formed to include a fuel vapor entry port 50, an atmospheric air entry port 70, and a fuel vapor-conducting passageway 52, 56, 90, 92, 66 interconnecting fuel vapor entry port 50 and atmospheric air entry port 70. As suggested in FIG. 4, fuel vapor entry port 50 is located to admit fuel vapor 11 extant in filler neck 12 into fuel vapor-conducting passageway 52, 56, 90, 92, 66. Atmospheric air entry port 70 is located to discharge scrubbed fuel vapor 101 through a vapor-discharge passageway 91 formed between closure 24 and cover 26 to atmosphere 13 surrounding fuel cap 10.

Hydrocarbon filter unit 120 is positioned to lie in fuel vapor-conducting passageway 52, 56, 90, 92, 66 to adsorb hydrocarbon material entrained in fuel vapor 11 passing from fuel tank filler neck 12 into fuel vapor-conducting passageway 52, 56, 90, 92, 66 through fuel vapor entry port 50 to produce a stream of filtered vapor 101 exiting fuel vapor-conducting passageway 52, 56, 90, 92, 66 through atmospheric air entry port 70. In an illustrative embodiment, hydrocarbon filter unit 120 is located in hydrocarbon filter bed storage area 66 near atmospheric air entry port 70.

Purge means is provided for applying a purge vacuum 116 to a region 92 in the fuel vapor-conducting passageway 52, 56, 90, 92, 66 interposed between fuel vapor entry port 50 and hydrocarbon filter unit 120 to draw atmospheric air 13 through atmospheric air entry port 70 into and through hydrocarbon filter unit 120 to entrain hydrocarbon material adsorbed on hydrocarbon filter unit 120 to produce a stream of fuel vapor 201 containing such hydrocarbon material and moving through a vapor-discharge channel 62 formed in closure 24 toward an engine intake manifold 16 associated with closure 24. The purge means includes a tether 22 coupled at one end to the closure 24 and at another end to engine intake manifold 16 to limit movement of closure 24 relative to engine intake manifold 16 upon separation of closure 24 from a fuel tank filler neck 12 adapted to mate with closure 24. Tether 22 is a purge hose formed to include a fluid-conducting passageway 122 interconnecting vapor-discharge channel 62 and engine intake manifold 16 in fluid communication to conduct stream of hydrocarbon-rich fuel vapor 201 to engine intake manifold 16 as suggested, for example, in FIG. 5.

A cover 26 is arranged to overlie closure 24 and adapted to be gripped and moved by a user to remove closure 24 from fuel tank filler neck 12. Vapor-discharge channel 62 is arranged to extend through an aperture 126 formed in cover 26 to mate with tether 22 as suggested in FIGS. 3 and 4.

Fresh-air filter 34 is interposed in a vapor-discharge passageway 91 provided between closure 24 and cover 26 and opened to atmosphere 13. Fresh-air filter 34 is configured to intercept and filter atmospheric air 13 drawn into hydrocarbon filter unit 120 through atmospheric air entry port 70 during operation of the purge means.

Cover 26 is mounted for movement relative to closure 24 and tether 22. A torque-override system 72 is interposed between and coupled to each of cover 26 and closure 24 and is configured to establish a torque-limited connection between cover 26 and closure 24 during installation of closure 24 on fuel tank filler neck 12 and a direct-drive connection between cover 26 and closure 24 during removal of closure 24 from fuel tank filler neck 12. Fresh-air filter 34 is arranged to cause atmospheric air 13 drawn into hydrocarbon filter unit 120 through atmospheric air entry port 70 during operation of the purge means to have passed first from atmosphere 13 into a vapor-discharge passageway 91 formed between closure 24 and cover 26 to contain torque-override system 72 and through torque-override system 72 and fresh-air filter 34. In illustrative embodiments, fresh-air filter 34 is formed to include a hole 33 and vapor-discharge channel 62 is arranged to extend upwardly through hole 33 as shown best in FIGS. 4 and 5.

In illustrative embodiments, closure 24 includes a top wall 68 formed to include atmospheric air entry port 70 and fresh-air filter 34 is arranged to lie on top wall 68 to cover atmospheric air entry port 70. This arrangement causes fluid 13 or 101 exiting and entering atmospheric air entry port 70 to pass through fresh-air filter 34.

Closure 24 includes an upper housing 32 formed to include atmospheric air entry port 70 and a downstream portion 66 of fuel vapor-conducting passageway 52, 56, 90, 92, 66 containing hydrocarbon filter unit 120 and communicating with atmospheric air entry port 70. Closure 24 further includes a lower housing 30 including a side wall 144 formed to include fuel vapor entry port 50 as suggested in FIGS. 4 and 5. Lower housing 30 is arranged to cooperate with upper housing 32 to form an upstream portion 90 of fuel vapor-conducting passageway 52, 56, 90, 92, 66 surrounding hydrocarbon filter unit 120. Lower housing 30 includes a bottom wall 46 lying in spaced-apart relation to hydrocarbon filter unit 120 to define a midstream portion 92 of fuel vapor-conducting passageway 52, 56, 90, 92, 66 underlying hydrocarbon filter unit 120, overlying bottom wall 46, and interconnecting upstream and downstream portions 90, 66 of fuel vapor-conducting passageway 52, 56, 90, 92, 66 to provide fluid communication therebetween.

Hydrocarbon filter unit 120 includes a group of activated charcoal pellets 67 defining a hydrocarbon filter 20, an upper sponge filter 36 interposed between the group of activated charcoal pellets 67 and fresh-air filter 34, and a lower sponge filter 42 interposed between the group of activated charcoal pellets 67 and bottom wall 44 of lower housing 30. Upper sponge filler 36 is also interposed between top wall 68 of upper housing 32 and hydrocarbon filter 20.

Upper housing 32 includes a top wall 68 formed to include atmospheric air entry port 70 and arranged to support fresh-air filter 34. Top wall 68 is also formed to include a central aperture 168, and upper housing 32 further includes an inner sleeve 60 extending through central aperture 168 as shown, for example, in FIGS. 4 and 5. Inner sleeve 60 of upper housing 32 includes a lower portion 601 passing through a central aperture 37, 69 formed in hydrocarbon filter unit 120 to lie in fluid communication with midstream portion 92 of fuel vapor-conducting passageway 52, 56, 90, 92, 66 and an upper portion 602 extending through a hole 33 formed in fresh-air filter 34 and defining vapor-discharge channel 62.

The purge means further includes a valve seat 80 associated with vapor-discharge channel 62, a purge hose 22 coupled to vapor-discharge channel 62 at one end and adapted to be coupled to engine intake manifold 16 at another end, and a vacuum-actuated regulator 38, 39. Vacuum-actuated regulator 38, 39 is mounted for movement from a normally closed position engaging valve 80 (as shown in FIG. 4) to block flow of fuel vapor 201 from hydrocarbon filter unit 120 through purge hose 22 toward engine intake manifold 16 and to an opened position disengaging valve seat 80 (as shown in FIG. 5) to allow flow of fuel vapor 201 laden with hydrocarbon material separated from hydrocarbon filter unit 120 through purge hose 72 upon exposure of vapor-discharge channel 16 to a purge vacuum 116 communicated by purge hose 22.

Hydrocarbon filter unit 120 is formed to include a central aperture 36, 69 and vapor-discharge channel 62 is arranged to extend downwardly through central aperture 36, 69 to cause hydrocarbon filter unit 120 to surround a portion of vacuum-actuated regulator 38, 39. Hydrocarbon filter unit 120 includes a group of activated charcoal pellets 67. Upper and lower sponge filters 36, 42 cooperate to provide means for retaining activated charcoal pellets 67 in a confined region in fuel vapor-conducting passageway 52, 56, 90, 92, 66 so that activated charcoal pellets 67 are unable to escape from container 31 through fuel vapor entry port 50 and atmospheric entry port 70 during flow of fuel vapor through fuel vapor-conducting passageway 52, 56, 90, 92, 66.

Closure 24 further includes rollover means 58 for effectively closing a fuel vapor entry port 50, 56 formed in closure 24. Such closure prevents liquid fuel 21 from passing into fuel vapor-conducting passageway 52, 56, 90, 92, 66 to reach hydrocarbon filter unit 120 during rollover of closure 24 as suggested, for example, in FIG. 6.

Closure 24 includes a lower housing 30 configured to mate with fuel tank filter neck 12 and an upper housing 32 arranged to extend into a container 31 included in lower housing 30. Container 31 includes a cylindrical side wall 44 and a round bottom wall 46 coupled to a lower end of side wall 46 to form an interior region containing hydrocarbon filter unit 120. Upper housing 32 includes an inner sleeve 60 formed to define vapor-discharge channel 62 and an outer sleeve 64 arranged to surround inner sleeve 60 to define a space therebetween containing hydrocarbon filter unit 120 and to cooperate with side wall 44 of the container to define a portion 90 of fuel vapor-conducting passageway 52, 56, 90, 92, 66 therebetween. Lower housing 30 further includes at least one standoff 48 coupled to bottom wall 46 and arranged to extend upwardly to engage an underside of hydrocarbon filter unit 120 to define a portion 92 of fuel vapor-conducting passageway 52, 56, 90, 92, 66 between bottom wall 46 and hydrocarbon filter unit 120 so that fuel vapor 11 admitted into container 31 can flow around the at least one standoff 48 and then upwardly and through hydrocarbon filter unit 120 to reach atmospheric air entry port 70 formed in top plate 68 of upper housing 32.

The invention claimed is:

1. An evaporative emissions control system comprising a closure structured to mate with and close a fuel tank filler neck, the closure being formed to include a fuel vapor entry port, an atmospheric air entry port, and a fuel vapor-conducting passageway interconnecting the fuel vapor entry port and the atmospheric air entry port, a hydrocarbon adsorbing filter unit positioned to lie in the fuel vapor-conducting passageway to adsorb hydrocarbon material entrained in fuel vapor passing from the fuel tank filler neck into the fuel vapor-conducting passageway through the fuel vapor entry port to produce a stream of filtered vapor exiting the fuel vapor-conducting passageway through the atmospheric air entry port, and wherein the fuel vapor-conducting passageway from the fuel vapor entry port extends along a first direction, a second direction generally perpendicular to the first direction and through a passageway portion substantially filled with adsorbent material and extending along a third direction different from the first and second directions wherein fuel vapor passes from the fuel tank into the fuel vapor-conducting passageway through the fuel vapor entry port and produces a stream of filtered vapor exiting the fuel vapor-conducting passageway through the atmospheric air port.

2. The system of claim 1, further comprising an engine intake manifold and wherein a tether is coupled at one end to the closure and at another end to the engine intake manifold to limit movement of the closure relative to the engine intake manifold upon separation of the closure from a fuel tank filler neck adapted to mate with the closure and the tether is a purge hose formed to include a fluid-conducting passageway interconnecting the vapor-discharge channel and the engine intake manifold in fluid communication to conduct the stream of fuel vapor to the engine intake manifold.

3. The system of claim 2, further comprising a cover arranged to overlie the closure and adapted to be gripped and moved by a user to remove the closure from a fuel tank filler neck, the vapor-discharge channel being arranged to extend through an aperture formed in the cover to mate with the tether.

4. The system of claim 3, further comprising a fresh-air filter interposed in a vapor-discharge passageway provided between the closure and the cover and opened to the atmosphere and configured to intercept and filter atmospheric air drawn into the hydrocarbon filter unit through the atmospheric air entry port during operation of the purge means.

5. The system of claim 1, wherein the hydrocarbon adsorbing filter unit includes a group of activated charcoal pellets, an upper sponge filter located above the group of activated charcoal pellets, and a lower sponge filter interposed between the group of activated charcoal pellets and the bottom wall of the lower housing, and the upper and lower sponge filters cooperate to provide means for retaining the activated charcoal pellets in a confined region in the fuel vapor-conducting passageway so that the activated charcoal pellets are unable to escape from the closure through the fuel vapor entry port and the atmospheric entry port during flow of fuel vapor through the fuel vapor-conducting passageway.

6. The system of claim 1, wherein the closure further includes rollover means for closing the fuel vapor entry port formed in the closure to prevent liquid fuel from passing into the fuel vapor-conducting passageway to reach the hydrocarbon adsorbing filter unit during rollover of the closure.

7. The system of claim 1, wherein the closure includes a lower housing configured to mate with the fuel tank filter neck and an upper housing arranged to extend into a container included in the lower housing, the container includes a side wall and a bottom wall coupled to a lower end of the side wall to form an interior region containing the hydrocarbon adsorbing filter unit, the lower housing is formed to include the fuel vapor entry port, the upper housing is formed to include the atmospheric air entry port, and the lower and upper housings cooperate to form the fuel vapor-conducting passageway therebetween.

8. The system of claim 7, wherein the upper housing includes an inner sleeve formed to define the vapor-discharge channel and an outer sleeve arranged to surround the inner sleeve to define a space therebetween containing the hydrocarbon filter unit and to cooperate with the side wall of the container to define a portion of the fuel vapor-conducting passageway therebetween.

9. The system of claim 8, wherein the hydrocarbon adsorbing filter unit includes a group of activated charcoal pellets trapped between an upper sponge filter and a lower sponge filter.

10. The system of claim 8, wherein the lower housing further includes at least one standoff coupled to the bottom wall and arranged to extend upwardly to engage an underside of the hydrocarbon adsorbing filter unit to define a portion of the fuel vapor-conducting passageway between the bottom wall and the hydrocarbon adsorbing filter unit so that fuel vapor admitted into the container can flow around the at least one standoff and then upwardly and through the hydrocarbon adsorbing filter unit to reach the atmospheric air entry port.

11. The system of claim 7, wherein the upper housing includes a top plate formed to include the atmospheric air entry port and arranged to lie in spaced-apart relation to the bottom wall of the container to locate the hydrocarbon adsorbing filter therebetween.

12. The system of claim 11, wherein the hydrocarbon adsorbing filter unit includes a group of activated charcoal pellets trapped between an upper sponge filter and a lower sponge filter.

13. An evaporative emissions control system comprising a closure adapted to mate with and close a fuel tank filler neck, the closure being formed to include a fuel vapor entry port, an atmospheric air entry port, and a fuel vapor-conducting passageway interconnecting the fuel vapor entry port and the atmospheric air entry port, a hydrocarbon adsorbing filter unit positioned to lie in the fuel vapor-conducting passageway to adsorb hydrocarbon material entrained in fuel vapor passing from the fuel tank filler neck into the fuel vapor-conducting passageway through the fuel vapor entry port to produce a stream of filtered vapor exiting the fuel vapor-conducting passageway through the atmospheric air entry port, purge means for applying a purge vacuum to a region in the fuel vapor-conducting passageway interposed between the fuel vapor entry port and the filter unit to draw atmospheric air through the atmospheric air entry port into and through the hydrocarbon adsorbing filter unit to entrain hydrocarbon material adsorbed in the filter unit to produce a stream of fuel vapor containing such hydrocarbon material and moving through a vapor-discharge channel formed in the closure toward an engine intake manifold associated with the closure, an engine intake manifold and wherein the purge means includes a tether coupled at one end to the closure and at another end to the engine intake manifold to limit movement of the closure relative to the engine intake manifold upon separation of the closure from a fuel tank filler neck adapted to mate with the closure and the tether is a purge hose formed to include a fluid-conducting passageway interconnecting the vapor-discharge channel and the engine intake manifold in fluid communication to conduct the stream of fuel vapor to the engine intake manifold, a cover arranged to overlie the closure and adapted to be gripped and moved by a user to remove the closure from a fuel tank filler neck, the vapor-discharge channel being arranged to extend through an aperture formed in the cover to mate with the tether, and wherein the cover is mounted for movement relative to the closure and the tether and further comprising a torque-override system interposed between and coupled to each of the cover and the closure and configured to establish a torque-limited connection between the cover and the closure during installation of the closure on the fuel tank filler neck and a direct-drive connection between the cover and the closure during removal of the closure from the fuel tank filler neck and a fresh-air filter interposed in a space provided between the closure and the cover to cause atmospheric air drawn into the hydrocarbon adsorbing filter unit through the atmospheric air entry port during operation of the purge means to have passed first from the atmosphere into a vapor-discharge passageway formed between the closure and the cover to contain the torque-override system and through the torque-override system and the fresh-air filter.

14. An evaporative emissions control system comprising a closure adapted to mate with and close a fuel tank filler neck, the closure being formed to include a fuel vapor entry port, an atmospheric air entry port, and a fuel vapor-conducting passageway interconnecting the fuel vapor entry port and the atmospheric air entry port, a hydrocarbon adsorbing filter unit positioned to lie in the fuel vapor-conducting passageway to adsorb hydrocarbon material entrained in fuel vapor passing from the fuel tank filler neck into the fuel vapor-conducting passageway through the fuel vapor entry port to produce a stream of filtered vapor exiting the fuel vapor-conducting passageway through the atmospheric air entry port, purge means for applying a purge vacuum to a region in the fuel vapor-conducting passageway interposed between the fuel vapor entry port and the filter unit to draw atmospheric air through the atmospheric air entry port into and through the hydrocarbon adsorbing filter unit to entrain hydrocarbon material adsorbed in the hydrocarbon adsorbing filter unit to produce a stream of fuel vapor containing such hydrocarbon material and moving through a vapor-discharge channel formed in the closure toward an engine intake manifold associated with the closure, and further comprising a cover arranged to overlie the closure and adapted to be gripped and moved by a user to remove the closure from a fuel tank filler neck and a fresh-air filter interposed in a vapor-discharge passageway provided between the closure and the cover and opened to the atmosphere and configured to intercept and filter atmospheric air drawn into the hydrocarbon adsorbing filter unit through the atmospheric air entry port during operation of the purge means.

15. The system of claim 14, wherein the fresh-air filter is formed to include a hole and the vapor-discharge channel is arranged to extend upwardly through the hole.

16. The system of claim 14, wherein the closure includes a top wall formed to include the atmospheric air entry port and the fresh-air filter is arranged to lie on the top wall to cover the atmospheric air entry port to cause fluid exiting and entering the atmospheric air entry port to pass through the fresh-air filter.

17. The system of claim 14, wherein the closure includes an upper housing formed to include the atmospheric air entry port and a downstream portion of the fuel vapor-conducting passageway containing the hydrocarbon adsorbing filter unit and communicating with the atmospheric air entry port, and the closure further includes a lower housing including a side wall formed to include the fuel vapor entry port and arranged to cooperate with the upper housing to form an upstream portion of the fuel vapor-conducting passageway surrounding the hydrocarbon adsorbing filter unit and a bottom wall lying in spaced-apart relation to the hydrocarbon adsorbing filter unit to define a midstream portion of the fuel vapor-conducting passageway underlying the hydrocarbon adsorbing filter unit and interconnecting the upstream and downstream portions of the fuel vapor-conducting passageway to provide fluid communication therebetween.

18. The system of claim 17, wherein the hydrocarbon adsorbing filter unit includes a group of activated charcoal pellets, an upper sponge filter interposed between the group of activated charcoal pellets and the fresh-air filter, and a lower sponge filter interposed between the group of activated charcoal pellets and the bottom wall of the lower housing.

19. The system of claim 17, wherein the upper housing includes a top wall formed to include the atmospheric air entry port and arranged to support the fresh-air filter, the top wall is also formed to include a central aperture, and the upper housing further includes an inner sleeve extending through the central aperture and including a lower portion passing through a central aperture formed in the hydrocarbon adsorbing filter unit to lie in fluid communication with the midstream portion of the fuel vapor-conducting passageway and an upper portion extending through a hole formed in the fresh-air filter and defining the vapor-discharge channel.

20. An evaporative emissions control system comprising a closure adapted to mate with and close a fuel tank filler neck, the closure being formed to include a fuel vapor entry port, an atmospheric air entry port, and a fuel vapor-conducting passageway interconnecting the fuel vapor entry port and the atmospheric air entry port, a hydrocarbon adsorbing filter unit positioned to lie in the fuel vapor-conducting passageway to adsorb hydrocarbon material entrained in fuel vapor passing from the fuel tank filler neck into the fuel vapor-conducting passageway through the fuel vapor entry port to produce a stream of filtered vapor exiting the fuel vapor-conducting passageway through the atmospheric air entry port, purge means for applying a purge vacuum to a region in the fuel vapor-conducting passageway interposed between the fuel vapor entry port and the filter unit to draw atmospheric air through the atmospheric air entry port into and through the filter unit to entrain hydrocarbon material adsorbed in the hydrocarbon adsorbing filter unit to produce a stream of fuel vapor containing such hydrocarbon material and moving through a vapor-discharge channel formed in the closure toward an engine intake manifold associated with the closure, and wherein the purge means further includes a valve seat associated with the vapor-discharge channel, a purge hose coupled to the vapor-discharge channel at one end and adapted to be coupled to an engine intake manifold at another end, and a vacuum-actuated regulator mounted for movement from a normally closed position engaging the valve seat to block flow of fuel vapor from the hydrocarbon adsorbing filter unit through the purge hose toward the engine intake manifold and to an opened position disengaging the valve seat to allow flow of fuel vapor laden with hydrocarbon material separated from the hydrocarbon adsorbing filter unit through the purge hose upon exposure of the vapor-discharge channel to a purge vacuum communicated by the purge hose.

21. The system of claim 20, wherein the hydrocarbon adsorbing filter unit is formed to include a central aperture and the vapor-discharge channel is arranged to extend downwardly through the central aperture to cause the hydrocarbon adsorbing filter unit to surround a portion of the vacuum-actuated regulator.

22. An evaporative emissions control system comprising a closure structured to mate with and close an open mouth of a filler neck for a fuel tank, the closure including a fuel vapor entry port adapted for communication with fuel vapor within the fuel tank when the closure is mated with the filler neck and a vapor discharge channel in communication with the fuel vapor entry port and adapted to vent vapor through the closure, the fuel vapor entry port and the discharge channel together defining a vapor passageway through the closure, the fuel vapor-conducting passageway extending along a first direction, a second direction generally perpendicular to the first direction and through a passageway portion substantially filled with adsorbent material and extending along a third direction generally parallel to the first direction, and a hydrocarbon adsorbing filter in the vapor passageway so that fuel vapor passing along the third direction is filtered before exiting the vapor passageway.

23. The system of claim 22, wherein the closure comprises a lower housing and an upper housing, the lower housing comprising a container having a side wall, the upper housing comprising an outer sleeve arranged to extend into the container and formed to define a vapor chamber between the outer sleeve and the side wall.

24. The system of claim 23, wherein the upper housing further comprises an inner sleeve surrounded by the outer sleeve and formed to define the vapor discharge channel, the inner sleeve and the outer sleeve are formed to define a hydrocarbon adsorbing filter bed storage area therebetween, and the filter is located in the hydrocarbon adsorbing filter bed storage area.

25. The system of claim 24, wherein the upper housing includes a top plate coupled to an upper end of the outer sleeve and an upper end of the inner sleeve and the top plate is formed to include an atmospheric air entry port adapted to conduct air from the atmosphere into the hydrocarbon adsorbing filter bed storage area to reach the filter.

26. The system of claim 24, wherein the filter comprises an upper sponge filter arranged to surround the inner sleeve and lie at an upper end of the hydrocarbon adsorbing filter bed storage area, a lower sponge filter arranged to lie at a lower end of the hydrocarbon adsorbing filter bed storage area, and a group of activated charcoal pellets located in a space between the upper and lower sponge filters.

27. The system of claim 24, wherein the lower housing includes a bottom wall coupled to a lower end of the side wall to form an interior region and a plurality of upwardly projecting standoffs coupled to the bottom wall and configured to support a lower filter arranged to lie at a lower end of the hydrocarbon adsorbing filter bed storage area, and the plurality of standoffs and the lower filter are spaced to form a chamber therebetween.

28. The system of claim 24, further comprising a purge hose coupled to the vapor discharge channel and adapted to channel vapor from the closure to an intake manifold of an engine.

29. The system of claim 22, further comprising means for tethering the closure to an associated engine coupled to the vapor discharge channel, the means for tethering being formed to provide a vapor path from the filter means to an intake manifold of the engine.

30. The system of claim 22, further comprising a purge hose coupled to the vapor discharge channel and adapted to channel vapor from the closure to an intake manifold of an engine.

31. An evaporative emissions control system comprising a closure adapted to mate with and close an open mouth of a filler neck for a fuel tank, the closure including a fuel vapor entry port adapted for communication with fuel vapor within the fuel tank when the closure is mated with the filler neck, the closure comprises a lower housing and an upper housing, the lower housing comprising a container having a side wall, the upper housing comprising an outer sleeve arranged to extend into the container and formed to define a vapor chamber between the outer sleeve and the side wall, the upper housing further comprises an inner sleeve surrounded by the outer sleeve and formed to define the vapor discharge channel, the inner sleeve and the outer sleeve are formed to define a hydrocarbon filter bed storage area therebetween, and the filter means is located in the hydrocarbon filter bed storage area, a vapor discharge channel in communication with the fuel vapor entry port and adapted to vent vapor through the closure, the fuel vapor entry port and the discharge channel together defining a vapor passageway through the closure, filter means in the vapor passageway for capturing hydrocarbons admitted into the vapor passageway through the fuel vapor entry port, a purge hose coupled to the vapor discharge channel and adapted to channel vapor from the closure to an intake manifold of an engine, and wherein the closure includes a check valve mounted in the vapor passageway, the check valve is movable between an opened position and a closed position, and the check valve is movable in response to a purge vacuum extant in the intake manifold to allow vapor to flow through the filter means and the purge hose for combustion in the engine.

32. The system of claim 31, wherein the check valve is biased to a closed position to prevent vapor flow through the purge hose when the engine is not in operation.

33. A fuel cap system for use with a fuel tank, the system comprising a closure structured to mate with and close an open mouth of the fuel tank, the closure including a passageway adapted for passage of vapors from the fuel tank to the atmosphere, a hydrocarbon adsorbing filter housed in the closure and configured to filter substantially all of the vapors passing from the fuel tank to the atmosphere via the passageway and to capture hydrocarbons passing through the passageway, and wherein the passageway is shaped to cause the vapors to flow along a first direction into the closure, along a second direction different from the first direction to advance toward the hydrocarbon adsorbing filter and then along a third direction different from the first direction and second direction to advance the fuel vapor flow through the hydrocarbon fuel filter.

34. The system of claim 33, wherein the closure comprises an upper housing and a lower housing, the upper housing comprises a top plate, an inner sleeve, and an outer sleeve, the top plate is coupled to the outer sleeve and the inner sleeve at upper ends thereof, the lower housing comprises a cylindrical side wall and a bottom wall coupled to a lower end of the cylindrical side wall, the bottom wall and the cylindrical side wall cooperate to define a container, the upper housing is arranged to extend into the container, the outer sleeve is arranged to surround the inner sleeve to define a chamber therebetween, and the chamber receives and stores hydrocarbon adsorbing filter material.

35. The system of claim 34, wherein the closure further comprises an upper sponge filter arranged to surround the inner sleeve and to lie under the top plate in the chamber and a lower sponge filter arranged to lie above the bottom wall in the chamber, the upper sponge filter and the lower sponge filter are spaced apart from one another, and the hydrocarbon adsorbing filter comprises a group of activated charcoal pellets located in a space between the upper and lower sponge filters.

36. The system of claim 33, further comprising a purge hose coupled to the vapor discharge channel and adapted to channel vapor from the closure to an intake manifold of an engine.

37. A fuel cap system for use with a fuel tank, the system comprising a closure adapted to mate with and close an open mouth of the fuel tank, the closure including a passageway adapted for passage of vapors from the fuel tank to the atmosphere, a hydrocarbon adsorbing filter housed in the closure and configured to capture hydrocarbons passing through the passageway, and a purge hose coupled to the closure and adapted to conduct hydrocarbons captured in the filter to an intake manifold coupled to an engine associated with the fuel tank, and further comprising a check valve positioned in the passageway and mounted for movement between an opened position and a closed position blocking discharge of vapor until a purge vacuum generated in the intake manifold is applied by the purge hose to the hydrocarbon adsorbing filter.

38. An evaporative emissions control fuel cap system comprising a closure structured to mate with a fuel tank filler neck of a fuel tank, the closure comprising an upper housing and a lower housing, the upper housing comprising a top plate, an inner sleeve, and an outer sleeve, the top plate being coupled to the outer sleeve and the inner sleeve at upper ends thereof, the outer sleeve being arranged to surround the inner sleeve to define a chamber therebetween, the lower housing comprising a side wall and a bottom wall coupled to a lower end of the side wall, the bottom wall and the side wall defining a container, the upper housing arranged to extend into the container, a passageway formed in the closure, the passageway being defined between a fuel vapor entry port adapted for communication with fuel vapor in the fuel tank when the closure is in a closed position and a vapor discharge port in communication with the fuel vapor entry port and adapted to conduct vapor from the closure to the atmosphere, and filter means for capturing hydrocarbons passing through the chamber wherein the passageway is shaped to cause the vapors to flow along a first direction into the closure, along a second direction different from the first direction to advance toward the hydrocarbon adsorbing filter and then along a third direction different from the first direction and second direction to advance the fuel vapor flow through the hydrocarbon fuel filter.

39. The system of claim 38, wherein the filter means comprises a hydrocarbon filtering material, the system further comprising a purge hose coupled to the vapor-discharge port and is adapted to conduct vapor from the closure to an intake manifold of an engine.

40. The system of claim 39, wherein hydrocarbons captured in the hydrocarbon adsorbing filtering material are drawn therefrom into the intake manifold under a purge vacuum extant in the intake manifold during engine operation.

41. The system of claim 39, wherein the closure further comprises an upper sponge filter arranged surround the inner sleeve and to lie under the top plate in the chamber and a lower sponge filter arranged to lie above the bottom wall in the chamber, the upper sponge filter and the lower sponge filter are spaced apart to contain the hydrocarbon filtering material therebetween, and the upper and lower sponge filters are adapted to minimize discharge of filtering material from the chamber through the fuel vapor entry port and the vapor discharge port.

42. The system of claim 39, wherein the purge hose acts as a tether to retain the closure in tethered relation to an apparatus containing the fuel tank.

43. An evaporative emissions control fuel cap system comprising a closure adapted to mate with a fuel tank filler neck of a fuel tank, the closure comprising an upper housing and a lower housing, the upper housing comprising a top plate, an inner sleeve, and an outer sleeve, the top plate being coupled to the outer sleeve and the inner sleeve at upper ends thereof, the outer sleeve being arranged to surround the inner sleeve to define a chamber therebetween, the lower housing comprising a side wall and a bottom wall coupled to a lower end of the side wall, the bottom wall and the side wall defining a container, the upper housing arranged to extend into the container, a passageway formed in the closure, the passageway being defined between a fuel vapor entry port adapted for communication with fuel vapor in the fuel tank when the closure is in a closed position and a vapor discharge port in communication with the fuel vapor entry port and adapted to conduct vapor from the closure to the atmosphere, hydrocarbon adsorbing filter means comprising a filtering material for capturing hydrocarbons passing through the chamber, a purge hose coupled to the vapor-discharge port and adapted to conduct vapor from the closure to an intake manifold of an engine, wherein hydrocarbons captured in the filtering material are drawn therefrom into the intake manifold under a purge vacuum extant in the intake manifold during engine operation, and further comprising a check valve mounted in the passageway, the check valve being movable between an opened position and a closed position, the check valve operable to the opened position by means of a purge vacuum applied by the intake manifold, and the check valve providing for discharge of vapor from the hydrocarbon filtering material to the intake manifold.

44. The system of claim 43, wherein the check valve is mounted for movement inside the inner sleeve and the check valve comprises a biasing spring to bias the check valve against a valve seat during periods of nonuse of the engine to block flow of fuel vapor through the purge hose.

* * * * *